United States Patent [19]

Nigol et al.

[11] Patent Number: 4,514,237

[45] Date of Patent: Apr. 30, 1985

[54] METHOD OF HEAT TREATING STEEL WIRE

[76] Inventors: Olaf Nigol, 272 Markland Dr., Toronto, Ontario, Canada, M9C 1R7; John S. Barrett, R.R. #8, Orangeville, Ontario, Canada, L9W 3T5

[21] Appl. No.: 458,319

[22] Filed: Jan. 17, 1983

[51] Int. Cl.[3] ..... C21D 9/52

[52] U.S. Cl. ..... 148/142; 148/12 B

[58] Field of Search ..... 148/12 B, 142, 127, 148/12.3, 134, 12 R; 427/433, 406, 321; 428/659, 685; 204/210

[56] References Cited

U.S. PATENT DOCUMENTS

| | | | |
|---|---|---|---|
| 2,394,434 | 2/1946 | Elmendorf | 148/134 |
| 2,511,274 | 6/1950 | Kramer | 148/134 |
| 2,853,768 | 9/1958 | Boucek | 428/659 |
| 3,057,050 | 10/1962 | Hodge et al. | 428/685 |
| 3,240,570 | 3/1966 | Grimes, Jr. et al. | 428/659 |
| 3,647,571 | 3/1972 | Okamoto et al. | 148/142 |
| 3,658,600 | 4/1972 | Pryor et al. | 148/12.7 A |

*Primary Examiner*—Peter K. Skiff

*Attorney, Agent, or Firm*—Ridout & Maybee

[57] ABSTRACT

Cold drawn carbon steel wire, more particularly stranded galvanized wire for use in overhead power transmission lines, is heat treated in the untensioned state for a period of at least one hour at a temperature in the range 150° C.-200° C. The preferred temperature is about 175° C. The treated wire has a reduced susceptibility to permanent elongation under tensile stress. ACSR conductors incorporating such wire as the steel reinforcement have a greatly reduced sag under heavy ice loading.

10 Claims, 6 Drawing Figures

METHOD OF HEAT TREATING STEEL WIRE

This invention relates to the heat treatment of cold drawn carbon steel wire, for use more particularly in overhead transmission lines, whereby to reduce the susceptibility of the wire to permanent elongation when subjected to tensile stress.

Overhead transmission line conductors are subjected to severe tensile stresses when loaded with ice. In an ACSR (Aluminum Conductor Steel Reinforced) conductor the steel core takes a large part of the tensile stress and undergoes strain giving rise to conductor sag. The resultant strain is not wholly elastic and the steel core does not recover to its original length when the stress is relieved. In consequence the conductor acquires a permanent sag due to the permanent elongation of the steel core, and in a transmission line which has been subjected to heavy ice loading the resultant permanent sag may necessitate restringing of the conductors of the transmission line, which is a costly undertaking.

The applicants have discovered that this tendency to creep can be greatly reduced by suitable heat treatment of the steel wire, called ageing, the treated wire being suitable for use in overhead transmission lines, as in the cores of ACSR conductors and as in the steel ground conductors of such lines. During a thermal investigation of the properties of ACSR conductors tests were performed on single steel core wires to determine the effect of temperature on the tensile properties of the steel cores in service. It was discovered, contrary to expectations, that the stress-strain and creep properties of the steel wires were greatly improved after a heat treatment at 143° C. for 20 hours. Accordingly, further investigations were made on both galvanized and ungalvanized steel wires to determine the optimum ageing temperature and ageing time. As a result of the further investigations the applicants have devised a method of treating steel wire to be used in ACSR conductors and in ground conductors for power transmission lines to improve its creep properties.

The method is applicable to hard-drawn carbon steel wire meeting CSA Standard C49.1-1975 and ANSI/ASTM Standard B498, the steel composition having a carbon content in the range 0.50%–0.85%. According to the aforesaid CSA and ASTM standards, which govern the galvanized steel wires for use in ACSR conductors, the minimum allowable elongation at which the wire breaks is between 3% and 4%, depending on wire diameter. Thus, in all cases, the wire will have breaking strain values greater than 3%.

According to the invention there is provided a method of treating cold drawn carbon steel wire having a carbon content in the range 0.50%–0.85% for use in power transmission lines, whereby to reduce the ductility of the wire and its susceptibility to permanent elongation under tensile strain, which method comprises heating the wire to a temperature in the range 150° C.–200° C. while maintaining the wire in an untensioned state and maintaining the untensioned wire at such temperature for at least one hour, the wire thereafter being cooled to ambient temperature.

The preferred treatment temperature is about 175° C., i.e. 170° C.–180° C., and the preferred treatment time is 5 hours. An important, though fortuitous, feature of the method is that the range of effective temperatures is below the temperature 235° C. at which the zinc coating of galvanized wire would be damaged, and so the method is especially suitable for the treatment of galvanized wires such as are used in the stranded steel cores of ACSR conductors.

It should be mentioned that methods of treating carbon steel to improve its resistance to creep have previously been proposed, more particularly for prestressed concrete applications where long term stress-relaxation has long been a major concern. Canadian Pat. No. 589,202 issued on Dec. 22, 1959 to Somerset Wire Company Limited discloses one such method in which a drawing tension is applied to the wire while the wire is subjected to a tempering temperature in the range 220° C. to 500° C. However, it has been observed that in this method the drawing tension is necessary since if the wire is not subjected to tension while being treated its stress-relaxation properties are even worse than those of the untreated wire. ("The Development of Stabilized Wire and Strand" by T. Cahill—WIRE JOURNAL, Vol. 39 No. 10, October 1964.)

In the case of overhead power transmission lines, on the other hand, the problem of stress-relaxation is of no concern. It is the problem of permanent elongation giving rise to conductor sag which matters, and the present invention is specifically addressed to the latter problem.

In order that the invention may be readily understood, examples of its application to the treatment of both galvanized and ungalvanized steel wire will now be described with reference to the accompanying drawings. In the drawings.

Figure 1:
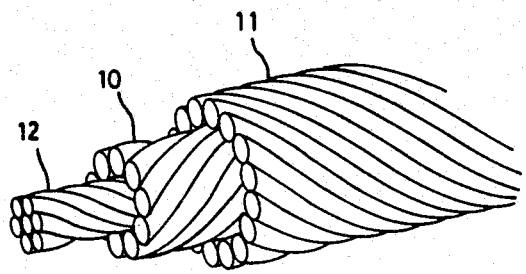
FIG. 1 is a fragmentary perspective view showing part of an ACSR conductor.

FIG. 1 illustrates the structure of a typical ACSR conductor. This comprises one or more layers, in this case two layers 10, 11, of aluminum strands wound helically on a stranded steel core 12. The specifications of the components are as set out in CSA Standard C49.1 or ANSI/ASTM Standard B498, but for the purpose of the present description it is sufficient to note that the strands of the core are of cold drawn carbon steel having the following composition:

| | |
|---|---|
| Carbon | 0.50–0.85% |
| Manganese | 0.50–1.10% |
| Phosphorus | <0.035% |
| Sulfur | <0.045% |
| Silicon | 0.10–0.35%. |

In accordance with the aforementioned CSA and ASTM standards, this steel has breaking strain values greater than 3.0%. The steel strands of the core are galvanized and in accordance with the present invention they may be hot-dip galvanized before the heat treatment, or they may be electro-galvanized either before or after the heat treatment. The treatment could also be applied to alumoweld or copperweld wires, which are steel wires having a thin cladding of aluminum or copper.

Figure 2:
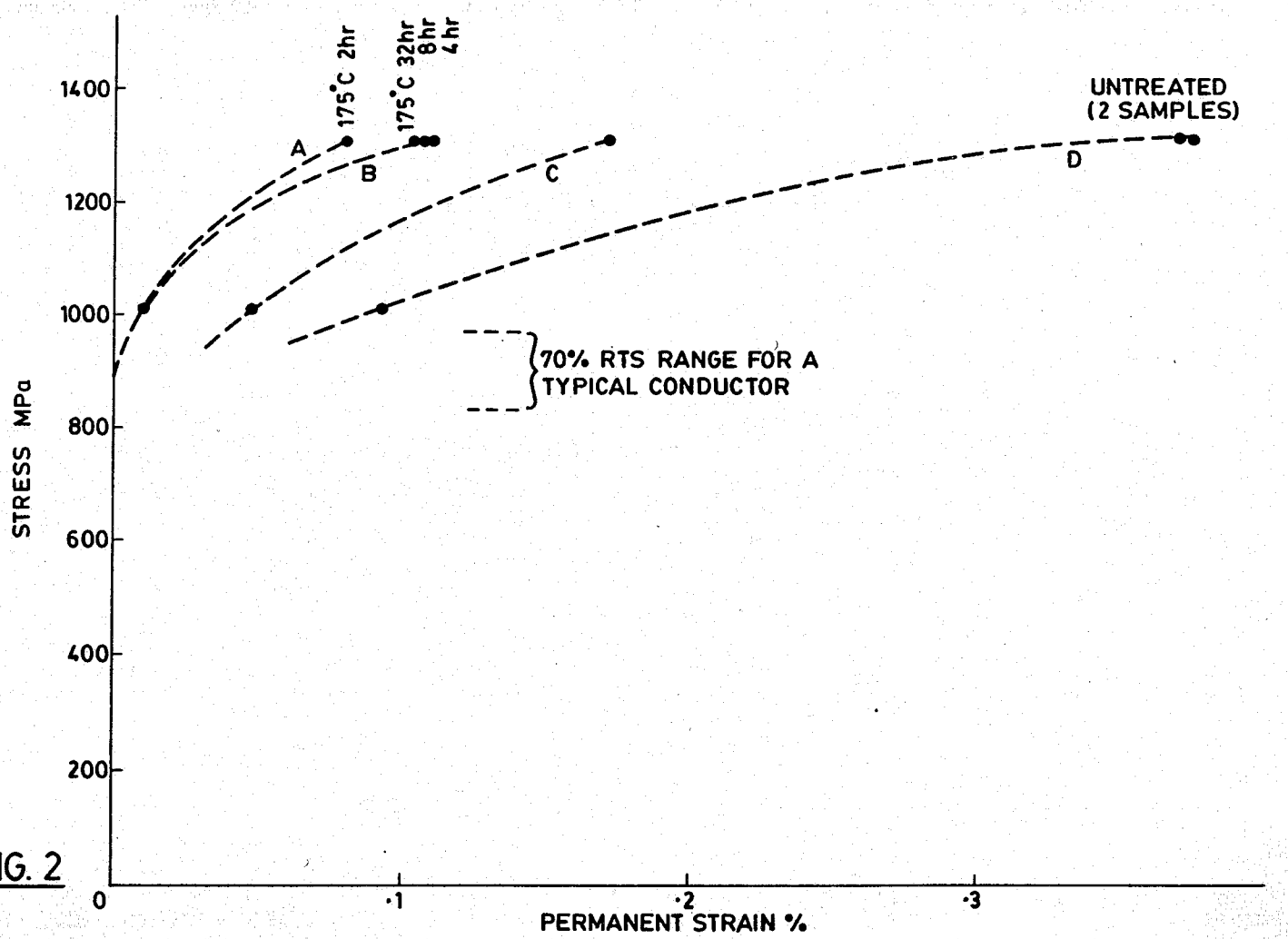
FIG. 2 is a graph showing the effects of different heat treatments on ungalvanized steel wires.

Samples of steel wire for use in ACSR conductors have been subjected to varying heat treatments, the wires being maintained in an untensioned state during such treatment in each case, and their permanent strains when subjected to different stresses were measured. FIG. 2 shows the stress-strain results for samples treated at two different temperatures and two untreated samples. The wires of these samples were ungalvanized.

In FIG. 2, Curve A shows the relationship between the applied stress and resultant permanent strain for a wire which has been treated at 175° C. for 2 hours. Curve B shows the relationship for wires which have been treated at 175° C. for 32 hours, 8 hours and 4 hours, respectively. Curve C shows the relationship for a wire which has been treated at 143° C. for 20 hours. Curve D shows the relationship for untreated samples.

It will be noted that for wires loaded to a tension corresponding to that in composite ACSR conductors loaded to 70% of their RTS (rated tensile strength), 800–900 MPa, the permanent strain is greatly reduced in those samples which have been heat treated. The treatment is more effective at 175° C. than at 143° C., and the time of treatment is not critical according to these results.

Figure 3:
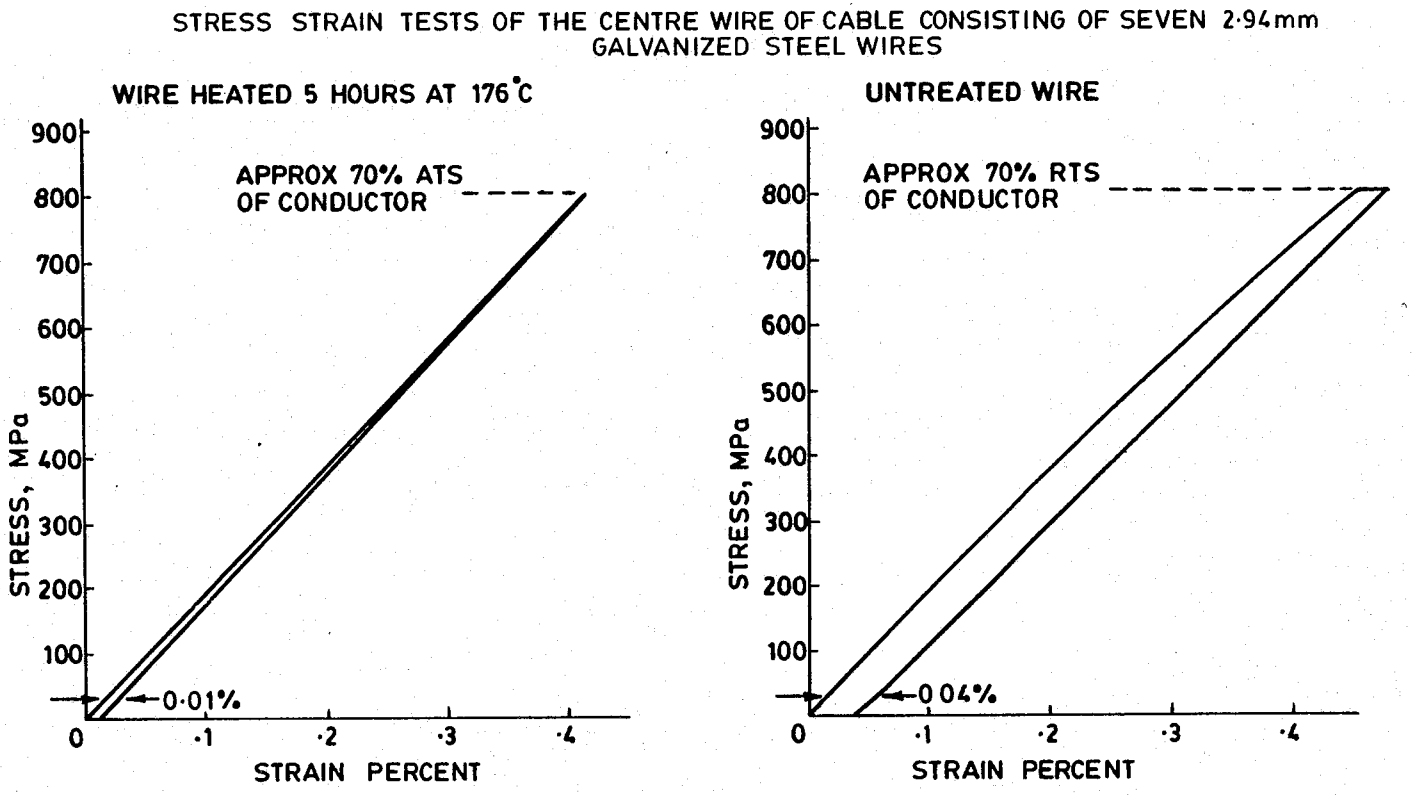
FIG. 3 shows comparative stress-strain curves for treated and untreated ungalvanized steel wires.

FIG. 3 shows comparative stress-strain curves for treated and untreated samples of galvanized wire. In this case the treated wire had been heated to 176° C. and maintained at that temperature for 5 hours, the wire thereafter being cooled to ambient temperature. Both samples were tensioned to 800MPa, corresponding to 70% of the RTS (rated tensile strength) of the composite ACSR conductors, and thereafter the applied tensile stress was reduced to zero. It will be noted that both samples experienced permanent elongation, this being about 0.04% for the untreated sample and 0.01% for the treated sample.

Figure 4:
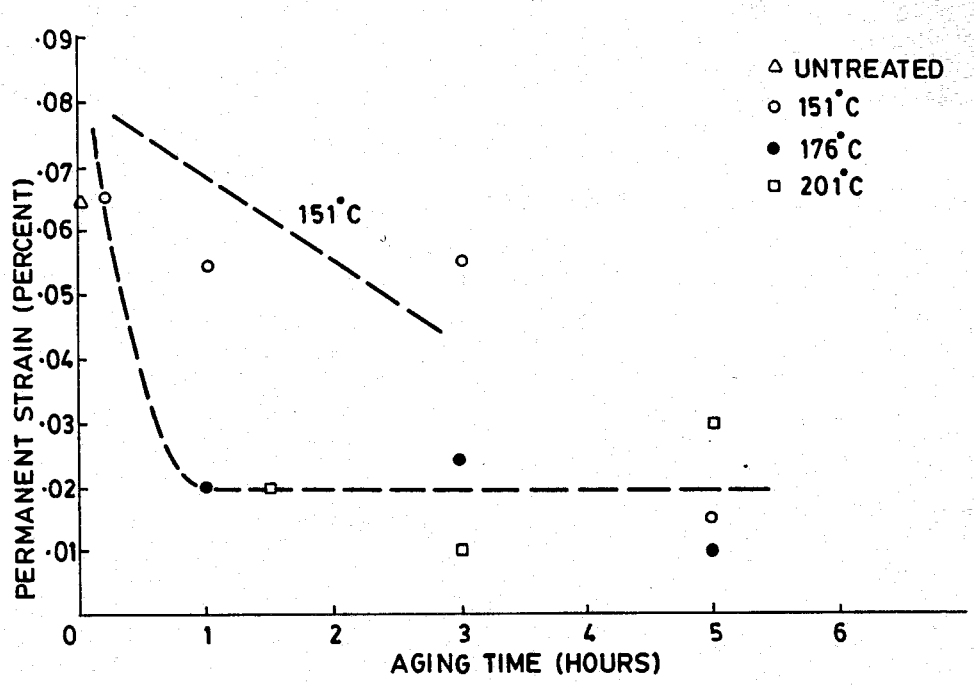
FIG. 4 is a graph showing the effects of different treatment times at different temperatures.

To determine whether a similar improvement could be obtained with stranded steel core as used in ACSR conductors, a 7-wire stranded galvanized core forming a cable was produced for test purposes. Prior to the treatment of the complete core single strands of 2.94 mm diameter were removed for preliminary testing. These were treated at 151° C. for 1 hour, 176° C. for durations of 3 hours, and 201° C. for 5 hours. The treated samples as well as untreated samples were each subjected to a tensile stress of 1008 MPa, corresponding to the stress that would occur when the composite ACSR conductor is loaded to 75% of its rated tensile strength, for a period of half an hour. The permanent strains were measured and the results are plotted in FIG. 4. Notwithstanding the scatter of the plotted points, it is apparent from FIG. 4 that heat treatments at temperatures throughout the range 150° C.–200° C. are effective in reducing the amount of permanent stress substantially, the optimum temperature being about 176° C. Again it is noted that the treatment time is not critical but must be at least one hour. For lower treatment temperatures there is a more noticeable improvement if the treatment time is extended, a minimum treatment time of 5 hours being preferable if the temperature is in the region of 150° C.

The results show that the effective range of treatment temperatures is from about 150° C. to 200° C. Although treatment temperatures lower than 150° C. may be effective, as FIG. 2 shows, they require longer treatment times and for that reason are not of practical value having regard to the reduced benefit obtained. On the other hand, while treatment temperatures above 200° C. may be effective they are less effective than temperatures within the stated range 150° C.–200° C., and should in any case be avoided in view of the likelihood of annealing and damage to zinc coated wires.

The stranded core was reeled and placed in an oven where it was heated to a nominal temperature of 175° C. and maintained at that temperature for 5 hours. The actual temperature, as measured by thermocouples ranged from 163° C. to 182° C. at different locations within the reel. The reel of stranded steel core wire was then allowed to cool to ambient temperature, after which it was subjected to stress-strain measurements. Corresponding measurements were performed on an identical stranded core which had not been heat treated.

Figure 5:
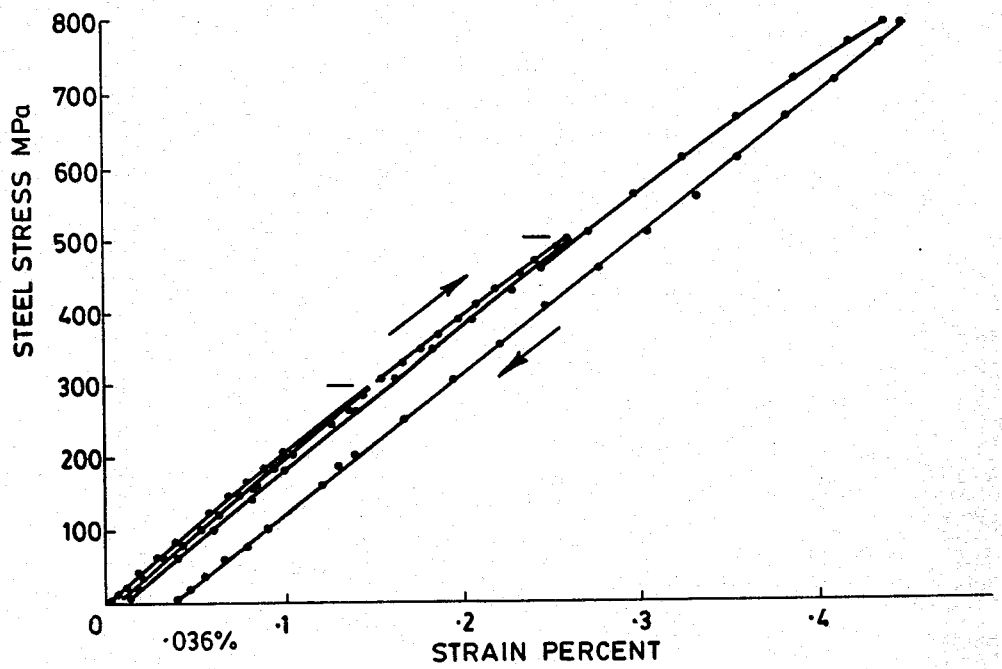
FIG. 5 shows a stress-strain curve for an untreated, stranded steel cable composed of galvanized wire.

FIG. 5 is a plot of the stress-strain measurements performed on the untreated core, the particulars of the wire being as follows:

| | |
|---|---|
| Gauge Length | 25.4 m |
| Measured Wire Diameter | 2.94 mm |
| Elastic Modulus | 193 GPa (28.0 × $10^6$ p.s.i). |

Figure 6:
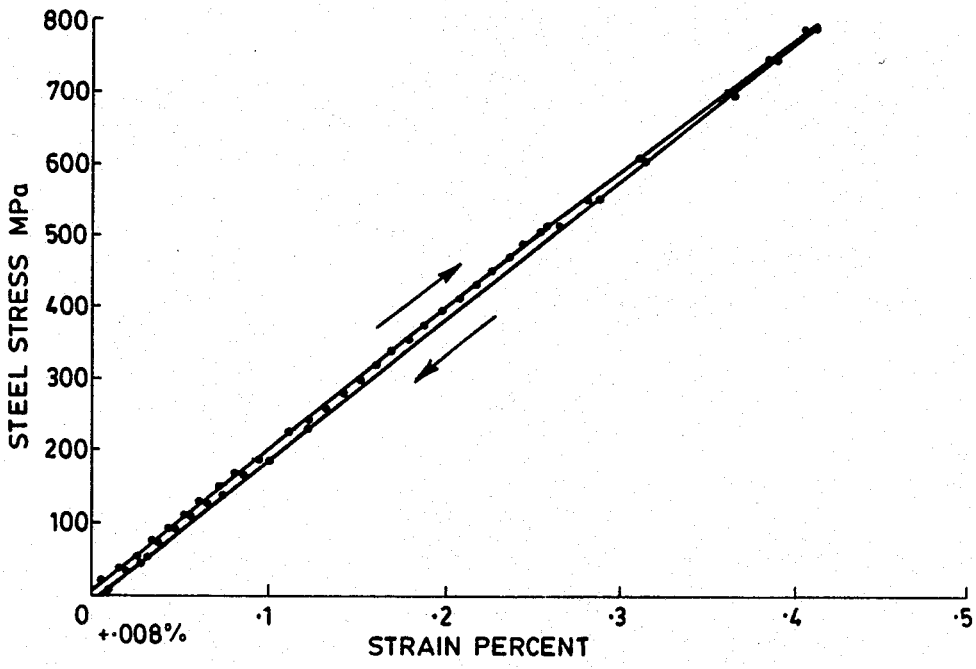
FIG. 6 shows a stress-strain curve for a treated stranded steel cable composed of galvanized wire.

FIG. 6 is a corresponding plot of the stress-strain measurements performed on the treated core, the particulars of the wire being as follows:

| | |
|---|---|
| Gauge Length | 25.4 m |
| Measured Wire Diameter | 2.94 mm |
| Elastic Modulus | 195 GPa (28.3 × $10^6$ p.s.i). |

The results show that the permanent strain was substantially less in the case of the treated core. The permanent strain was reduced from 0.036% for the untreated core to 0.008% for the treated core after loading corresponding to 70% rated tensile strength of the composite ACSR conductor. These results from the cores agree well with those of FIG. 3 on single wires stressed to the same degree. It should be mentioned that the steel of the core wires in these samples was of a particularly high quality. A core manufactured to meet CSA or ANSI/ASTM specifications typically has a permanent strain of about 0.06% after 70% rated tensile strength loading, and in some cases as high as 0.10%. The benefit obtained by heat treatment would be even greater for such cores than for those described above.

On the basis of these investigations the applicants have devised a method of treating cold drawn, stranded or unstranded, carbon steel cable or wire having a carbon content in the range 0.50%–0.85% for use in power transmission lines, more particularly in ACSR conductors, whereby to reduce the susceptibility of the wire to permanent elongation under tensile stress. The wire may be galvanized or ungalvanized. The method comprises placing a reel or coil of the wire in an oven and heating the reel therein to a mean temperature in the range 150° C.–200° C., preferably in the range 170° C.–180° C. The wire is maintained in an untensioned state, that is to say no tension is applied to it, and is maintained at that temperature for period of at least 1 hour, but preferably 5 hours. The wire is then allowed to cool to ambient temperature. It is then ready for use as the reinforcing core of an ACSR conductor or as a ground conductor.

The steel contribution to the rated tensile strength (RTS) of an ACSR conductor is calculated from the nominal stress of the steel wire at 1 percent elongation. For an untreated core wire from 28.1 mm (26/7) ACSR (DRAKE) conductor the nominal steel stress at 1 percent elongation is 1100 MPa (160,000 psi). For a treated wire, 1400 MPa (200,000 psi) is a conservative value to use for the nominal stress at 1 percent elongation. The measured values usually exceed 1500 MPa. The calculated rated tensile strength values for the complete ACSR conductors are:

| | RTS |
|---|---|
| Untreated - Core 28.1 mm (26/7) ACSR | 139 MPa |
| Treated - Core 28.1 mm (26/7) ACSR | 157 MPa. |

Using the RTS values given above, the sag-tension calculations have been made for various loading conditions. For the core of the untreated conductor, the permanent elongation after 70 percent RTS loading of the conductor was assumed to be 0.060 percent. For the treated core a permanent strain of 0.015 percent at the same stress was used. FIGS. 2 and 6 illustrate that this latter value is conservatively large. The design constraints imposed on both conductors for the purpose of calculation were:

| Loading Condition | Conductor Tension Limit |
|---|---|
| 16° C. After 10 Yr Creep (Vibration) | 20% RTS |
| −18° C. After 10 Yr Creep (Vibration) | 25% RTS |
| −18° C., 19 mm ice, 479 Pa Wind (Design Ice & Wind) | 60% RTS |
| −18° C., 51 mm ice (Heavy Ice) | 90% RTS. |

In all cases one of the vibration limits was the governing condition, followed closely by the other vibration condition. The results of the calculations are given in Table 1.

TABLE 1

| LOADING CONDITION | SAGS IN 250 m SPAN (m) | | | SAGS IN 300 m SPAN (m) | | | SAGS IN 350 m SPAN (m) | | |
|---|---|---|---|---|---|---|---|---|---|
| | UN-TREATED | TREAT-ED | DIFFER-ENCE | UN-TREATED | TREAT-ED | DIFFER-ENCE | UN-TREATED | TREAT-ED | DIFFER-ENCE |
| Sagging in 16° C. | 3.90 | 3.39 | .51 | 5.55 | 4.77 | .78 | 7.82 | 6.63 | 1.19 |
| 16° C. after 10 year creep | 4.68 | 4.23 | .45 | 6.47 | 5.80 | .67 | 8.82 | 7.80 | 1.02 |
| During design ice and wind loading | 6.38 | 6.06 | .32 | 8.62 | 8.14 | .48 | 11.32 | 10.60 | .72 |
| Following design ice and wind loading (16° C.) | 5.21 | 4.74 | .47 | 7.17 | 6.50 | .67 | 9.69 | 8.69 | 1.00 |
| During heavy ice loading | 9.81 | 9.38 | .43 | 13.11 | 12.39 | .72 | 16.88 | 15.78 | 1.10 |
| Following heavy ice loading | 6.66 | 5.70 | .96 | 9.24 | 7.65 | 1.59 | 12.41 | 10.02 | 2.39 |
| 150° C. after stringing | 8.02 | 7.58 | .44 | 10.32 | 9.69 | .63 | 12.95 | 12.02 | .93 |
| 150° C. after 10 years | 8.02 | 7.58 | .44 | 10.32 | 9.69 | .63 | 13.09 | 12.19 | .90 |

It can be seen that the sag reduction is greatest following heavy ice loading and in long spans.

ACSR conductors employing cores treated as described above offer the following benefits:

1. Avoiding Costly Restringing: After 51 mm ice loading the advantage in permanent sag reduction of the treated core over the untreated core is approximately 1.6 m in a typical 300 m span. This difference in sag, or perhaps the difference under a less severe load, might in some cases satisfy the minimum ground clearance requirements and eliminate the costly restringing of transmission line conductors.
2. Tower Cost Savings: If the tower height is determined by the minimum ground clearance requirements under heavy ice loading conditions, it could be reduced by 0.7 m for 300 m spans. Using the present erected cost of tower steel of \$4.00/kg (±10%) and the weight per meter of X7S tower extensions of 210 kg/m, the cost saving would be approximately 0.7 m×210 kg/m×\$4.00/kg=\$588 per tower. This represents approximately 3.3 percent of the erected steel cost of an X7S tower.
3. Increased Current-Carrying Capacity: In a 300 m span, the 0.6 m reduction of sag at high temperatures represents an 18° C. advantage for the treated core conductor. Present operating temperatures under normal and emergency current loading conditions are limited to prevent excessive annealing of the aluminum wires. If standard conductors now in service can operate up to the present design temperatures without exceeding clearance limits then the current-carrying capacity cannot be increased by replacing the conductor by treated core conductor of the same size and type. However, if the minimum ground clearance limits the operating temperatures to lower values, restringing with a treated core conductor can increase the current-carrying capacity.

For example a 28.1 mm (26/7) ACSR "Drake" conductor at high temperatures can carry 9 amperes more current for every 1° C. of allowable temperature. Since the reduced sag of the treated core conductor results in an 18° C. temperature advantage, it has an added current-carrying capacity of approximately 160 amperes.

4. Better Quality Control: From stress-strain tests performed it is apparent that the quality of the aluminum wires in ACSR conductors is fairly uniform. However, the overall behaviour of the complete conductor is not consistent because of the wide variability of quality of the steel core. Measured permanent elongations of the steel cores after 70 percent RTS loading of the conductors range from 0.03 percent strain tests to more than 0.10 percent strain. Most computer programs used for design and operation of transmission lines use design curves with only 0.04 percent permanent strain. This can result in considerable errors in sag calculations. The use of treated steel cores would reduce the actual variability of the steel core so that most permanent strains would be in the range of 0.01 percent tp 0.02 percent strain after 70 percent RTS loading of the conductor. This would reduce uncertainty in sag calculations and result in more economical design and operation of transmission lines.

What we claim is:

1. A method of treating hard-drawn carbon steel core wire having breaking strain values greater than 3.0% and having a carbon content in the range 0.50–0.85% and used in aluminum conductor, steel reinforced power transmission lines, whereby to reduce the ductility of the wire and its susceptibility to permanent elongation under tensile strain, which method comprises heating the wire to a temperature in the range 150° C.–200° C. while maintaining the wire in an untensioned state at said temperature for at least one hour, the wire thereafter being cooled to ambient temperature, wherein permanent strain in the wire after said treatment is in the range of 0.01% to 0.02% after 70% RTS loading of the wire.

2. A method according to claim 1 wherein the wire is galvanized wire.

3. A method according to claim 1 wherein the wire comprises a stranded cable.

4. A method according to claim 3 wherein the strands of the cable are galvanized.

5. A method according to claim 1 wherein the temperature is in the range 170° C.–180° C.

6. A method according to claim 1 wherein the wire is maintained at said temperature for at least 5 hours.

7. A method of treating hard-drawn, stranded, carbon steel wire having breaking strain values greater than 3.0% and having a carbon content in the range 0.50–0.85% and used in aluminum conductor, steel reinforced power transmission lines, whereby to reduce the ductility of the wire and its susceptibility to permanent elongation under tensile strain, which method comprises placing a reel of said wire in an oven, treating the reel therein to a mean temperature in the range 150° C.–200° C. while maintaining the wire in an untensioned state at said temperature for at least 1 hour, the wire thereafter being cooled to ambient temperature, wherein permanent strain in the wire after said treatment is in the range of 0.01% to 0.02% after 70% RTS loading of the wire.

8. A method according to claim 7 wherein the strands of the wire are galvanized.

9. A method according to claim 8 wherein said temperature is maintained for at least 5 hours.

10. A method according to claim 8 wherein said mean temperature is in the range 170° C.–180° C.

* * * * *